United States Patent [19]

Rathbun et al.

[11] 4,068,375

[45] Jan. 17, 1978

[54] HEAVY DUTY RETRACTABLE BLADE UTILITY KNIFE

[75] Inventors: Richard H. Rathbun, Oakdale; Robert F. West, Simsbury, both of Conn.

[73] Assignee: The Stanley Works, New Britain, Conn.

[21] Appl. No.: 748,510

[22] Filed: Dec. 8, 1976

[51] Int. Cl.[2] ..... B26B 5/00

[52] U.S. Cl. ..... 30/125; 30/162; 30/164

[58] Field of Search ..... 30/2, 125, 151, 162, 30/164, 320, 329

[56] References Cited

U.S. PATENT DOCUMENTS

| | | | |
|---|---|---|---|
| 2,862,296 | 12/1958 | Anderson | 30/162 |
| 3,927,473 | 12/1975 | Braginetz | 30/162 |

*Primary Examiner*—Robert C. Watson

*Attorney, Agent, or Firm*—Prutzman, Hayes, Kalb & Chilton

[57] ABSTRACT

A retractable blade utility knife is formed of a pair of elongated mating handle halves separable along a plane extending longitudinally of the knife and terminating at one end in a blade receiving opening. A blade carrier is mounted between the handle halves for supporting a blade for reciprocation between an exposed and sheathed position. Each of the handle halves is provided with a longitudinal extending slot and the blade carrier is provided with a finger piece extending through one of the slots and a carrier base with an offset extension connected thereto by a necked portion extending through the other of said slots with the necked portion disposed in said slot. The finger piece is threadably received in a threaded dimple on the extension and is rotatable relative thereto to serve the dual function of securing the handle halves together and securing the blade carrier in adjusted position.

4 Claims, 4 Drawing Figures

FIG. 1
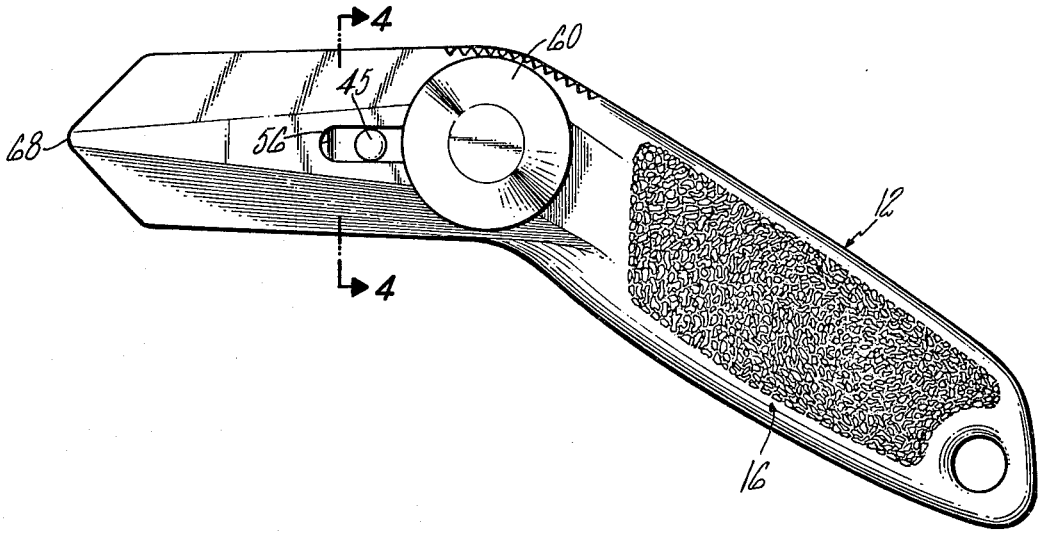
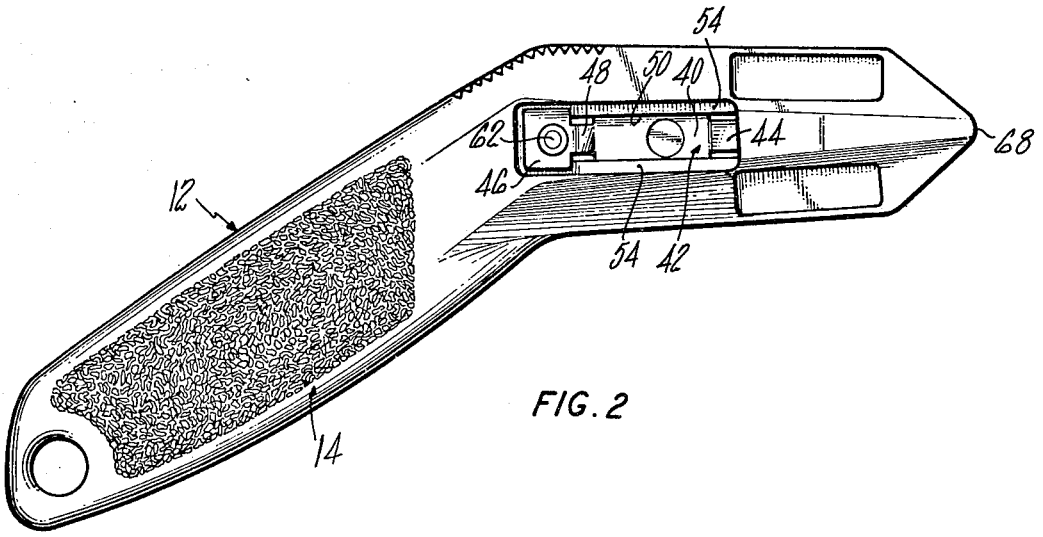
FIG. 2

HEAVY DUTY RETRACTABLE BLADE UTILITY KNIFE

This invention generally relates to heavy duty utility knives having retractable blades and more particularly to such knives suited for use by carpet installers.

A primary object of this invention is to provide an improved utility knife having separable handle parts and adapted to secure a removable blade in an extended cutting position for maximum depth of cut. Included in this object is the provision of an improved simplified blade carrier construction which permits the blade to be extended further than ordinary while being supported firmly.

A further object of this invention is to provide an improved knife of the type described wherein the blade carrier and a single operating screw serve to control the manipulation of the blade into its extended and sheathed positions as a pivot for the handle halves for blade replacement and to secure the handle halves together in operative position.

Another object of this invention is to provide an improved utility knife of the type described having a simple rugged construction which is quick and easy to manufacture and assemble from a minimum number of parts.

Other objects will be in part obvious and in part pointed out more in detail hereinafter.

A better understanding of the invention will be obtained from the following detailed description and the accompanying drawings of an illustrative application of the invention.

In the drawings:

FIG. 1 is a side elevational view showing the utility knife of the present invention;

FIG. 2 is a back side elevational view of the utility knife of FIG. 1;

Figure 3:
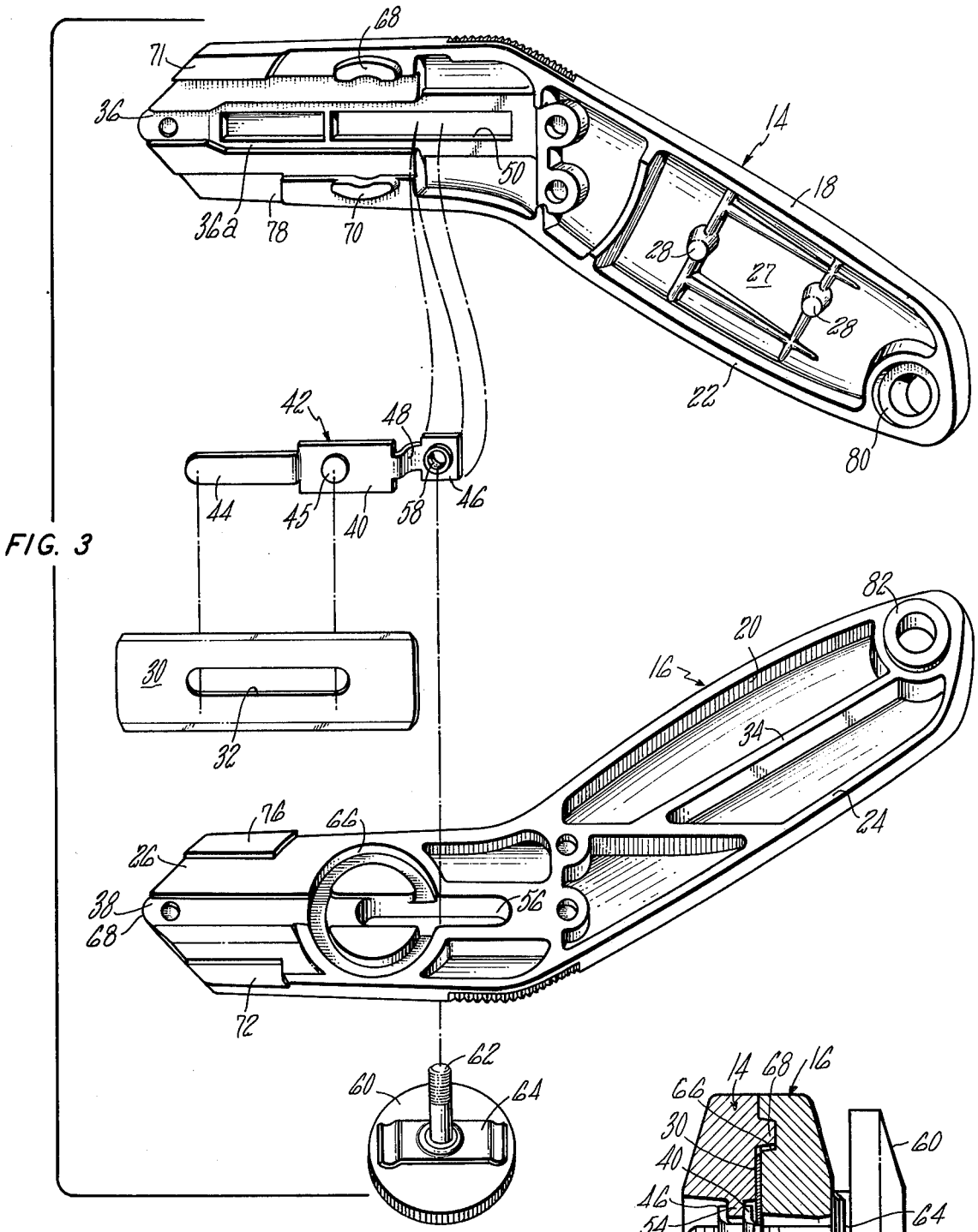
FIG. 3 is an exploded view showing the internal portions of the knife.

Referring now to the drawings in detail, a utility knife of this invention generally has an angled substantially hollow elongated handle 12 composed of two handle members or halves 14, 16.

The handle halves 14, 16 have peripheral side walls 18, 20 which terminate in abutting shoulders 22, 24 lying in a single longitudinal plane through the longitudinal center line of the handle. A blade receiving opening 26 is provided at the forward end of the knife.

A blade storage compartment 27 is conveniently formed in the hollow rear portion of the handle half 16 for housing spare blades. Compartment 27 is provided with a pair of spaced posts 28 which project from the bottom wall of the handle half 14 and are received in the center slot 32 of a plurality of spare blades 30 for securing them within the handle. A central web 34 is shown as being provided in the handle half 16 to engage the tops of the posts 28 with the top surface of the web 34 being in the plane of the surrounding shoulder 24 of the side wall 20.

Aligned with the blade receiving opening 26 at the forward end of the handle is a blade carrier receiving slot formed by mating longitudinal recesses 36, 38 of handle halves 14, 16, respectively, for supporting the flat base portion 40 of the blade carrier 42 for reciprocable movement within the handle 12. The side walls of the recesses 36, 38, respectively, closely engage the parallel side walls of the base portion 40 of the blade carrier 42 to prevent relative rotation therebetween.

The blade carrier 42 is provided at the forward end thereof with an integral raised tongue 44 which is dimensioned to be closely received in the slot 32 of a blade 30 and upset dimple 45 is provided on the base portion 40 of the blade carrier and is received at the rear end of the slot 32 of a blade 30 so as to cooperate with tongue 44 to prevent substantial longitudinal movement of the blade relative to the carrier.

Extending rearwardly of the base portion 40 of the blade carrier 42 is an integral extension 46 of the carrier. Extension 46 is offset below the plane of the base portion 40, or in the opposite direction from the offset of the tongue 44. The extension 46 is connected to the base portion 40 by a narrow neck portion 48.

Figure 4:
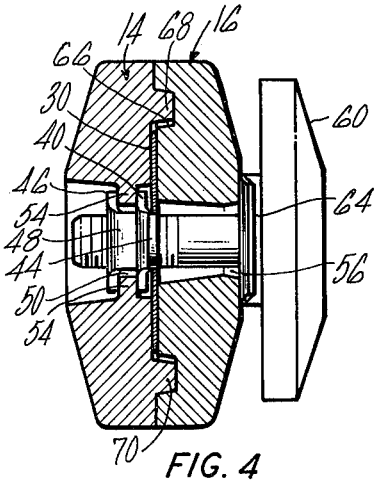
FIG. 4 is a cross-sectional view taken along lines 4—4 of FIG. 1.

An elongated rectangular slot 50 is provided in the bottom wall of the handle half 14 in alignment with the recess 36 thereof, and, as best shown in FIGS. 2 and 4, the outer surface of the handle half 14 is provided with a longitudinal recess generally coextensive with the slot 50 and overlying the slot to form a pair of lands 54. The blade carrier 42 is assembled with the handle half 14 by inserting the extension through the slot 50 with the neck portion 48 positioned between the lands 54 and the base portion 40 and the extension 46 straddling the lands 54 as best shown in FIG. 4 to interlock the blade carrier 42 and the lands 54.

It will be seen that the longitudinal recess 36 is enlarged beginning at a point spaced from the forward end of the handle as indicated at **36*a* to receive the base portion 40** of the blade carrier.

When the blade carrier 42 is installed with the handle half 14 and the blade is assembled thereon, the handle half 16 is positioned to overlie the handle half 14 in mating alignment therewith. In this position, the slot 56 overlies the slot 50 to expose the upstanding cylindrical threaded projection 58 formed on the extension 46 of the blade carrier. A button or locking screw 60 provides a threaded shank 62 which is inserted through the slot 56 to engage the threaded projection 58 and secure the handle halves together. If desired, a spring member 64 may be provided between the button 60 and the handle half 16 to resiliently bias the handle halves 14, 16 together.

It will be seen when the button 60 is loosened, it may be manipulated to sheath or extend the blade carrier 42 and to lock the blade carrier in any adjusted position.

In this regard, the forward end of the slot 56 is spaced close to the nose 68 of a knife so that the end of the tongue 44 may project from the end thereof by, say, $\frac{1}{8}$ inch. By virtue of this construction, a knife blade 30 mounted on blade carrier 42 may project further to expose a longer cutting surface which is useful when thick carpeting is being cut.

As shown in FIG. 3, the handle half 16 is provided with a circular recess 66 which receives the interrupted circular abutments 68, 70 that project above the plane of separation of the handle halves 14, 16 to align the handle halves in mating position when assembled and to permit the relative rotation of the handle halves with respect to each other when the blade carrier 42 is in its forward or extended position with the shank 62 at the forward end of the slot 56 so that a spent blade may be replaced on the blade carrier and to provide access to the blade storage compartment 27.

The handle halves 14, 16 are provided with mating recesses and stops to fix the assembled rotational position of the handle halves when the handle halves 14, 16 are rotated relative to each other to expose the blade carrier and are returned to their mating position.

As shown, handle half 14 is provided with a raised abutment 71 which projects above the plane of separation of the handle halves and is received in the mating recess 72 in the handle half 16. Similarly, handle half 16 is provided with a raised abutment 76 which projects above the plane of separation of the handle halves and is received in a recess 78 of the handle half 14 to fix the rotational positions of the handle halves so that the cooperation slots for the blade carrier and the knife blade are aligned.

The rear end of the handle halves are provided with a stop to secure the rotational positions of the handle halves when the button 60 is slightly loosened for the extension and retraction of the blade carrier and the blade. As shown, handle half 14 is provided with a circular recess 80 which receives a mating circular projection 82 which extends beyond the plane of separation of the handle halves a sufficient distance so that slight loosening of the button 60 for the longitudinal adjustment of the blade carrier will not unlatch the handle halves for rotation relative to each other.

From the foregoing, it will be seen that the locking screw 60 combines with the unique construction of the blade carrier to extend or sheath the blade in preselected positions to serve as a pivot for the relative angular movement of the handle halves to provide exposure to the storage compartment and the blade carrier for blade replacement, and at the same time to provide the sole securing means for maintaining the handle halves assembled together without the need for additional parts. In addition, by virtue of the spacing of the forward end of the slot 56 relative to the nose 68 of the handle so as to expose the end of the tongue 44 of the blade carrier, a standard blade may project further to expose a longer cutting surface suitable for use in cutting thick carpeting.

As will be apparent to persons skilled in the art, various modifications, adaptations and variations can be made without departing from the teachings of the present invention.

We claim:

1. A retractable blade utility knife having a blade receiving opening through one end thereof and comprising a pair of elongated mating handle halves separable along a plane generally extending longitudinally of the knife, a blade carrier having a base for supporting a blade thereon, said blade carrier being mounted between the handle halves for reciprocable movement toward and away from the blade receiving opening to shift a blade mounted thereon between an exposed and sheathed position, one of said handle halves providing a pair of spaced longitudinally extending lands defining a first longitudinal slot, the other of said handle halves defining a mating second longitudinal slot, a blade carrier having a finger piece and a carrier base with an offset extension connected to the carrier base by a necked portion, said necked portion being positioned in said first longitudinal slot with said extension and said base of the blade carrier being disposed on opposite sides of said lands to straddle the same, said finger piece being exposed through said second longitudinal slot and secured to the other of said handle halves for reciprocable movement therein, said finger piece further being secured to said extension thereby to secure the handle halves in assembled relation.

2. The knife of claim 1 wherein said blade carrier extension is provided with an apertured threaded dimple and said finger piece includes a threaded shank received therein whereby the finger piece is rotatable in one direction to clamp the handle halves together and to secure the blade carrier in an adjusted position and is rotatable in the opposite direction to permit the blade carrier to be longitudinally adjusted.

3. The knife of claim 1 wherein said blade carrier is provided at the forward end thereof with a raised integral tongue to secure a blade to the blade carrier, said lands being constructed to permit the end of the tongue to extend partially out of the blade receiving opening to increase the exposure of the blade.

4. The knife of claim 3 wherein said blade carrier extension is provided with an apertured threaded dimple and said finger piece includes a threaded shank received therein whereby the finger piece is rotatable in one direction to clamp the handle halves together and to secure the blade carrier in an adjusted position and is rotatable in the opposite direction to permit the blade carrier to be longitudinally adjusted.

* * * * *